United States Patent [19]

Wendt

[11] Patent Number: 4,584,808

[45] Date of Patent: Apr. 29, 1986

[54] CONCEALABLE DOUBLE ACTING FASTENER FOR WALLBOARD

[75] Inventor: Alan C. Wendt, Barrington, Ill.

[73] Assignee: United States Gypsum Company, Chicago, Ill.

[21] Appl. No.: 598,420

[22] Filed: Apr. 9, 1984

[51] Int. Cl.[4] ..... E04B 2/00; E04B 2/28

[52] U.S. Cl. ..... 52/483; 52/363; 411/458

[58] Field of Search ..... 411/458, 459, 460, 457; 52/483, 361, 363; 24/161, 152, 150 B, 150 R, 289, 357

[56] References Cited

U.S. PATENT DOCUMENTS

| | | | |
|---|---|---|---|
| 298,826 | 5/1884 | Scherling | 24/150 B |
| 638,386 | 12/1899 | Farrow | 411/458 |
| 989,198 | 4/1911 | Slayton | 411/458 |
| 1,186,383 | 6/1916 | Danly | 411/458 |
| 1,390,918 | 9/1921 | McFarland | 411/458 |
| 2,008,192 | 7/1935 | Stubbs | 52/361 |
| 2,326,506 | 8/1943 | Tummins | 411/458 |
| 2,620,705 | 12/1952 | Podvinecz | 411/460 |
| 4,043,092 | 8/1977 | Paul et al. | 52/712 |
| 4,117,644 | 10/1978 | Weinar | 52/714 |

FOREIGN PATENT DOCUMENTS

| | | | |
|---|---|---|---|
| 812008 | 4/1959 | United Kingdom | 52/483 |
| 1511068 | 5/1978 | United Kingdom | 52/714 |

*Primary Examiner*—Kenneth J. Dorner
*Assistant Examiner*—Adrian H. Whitcomb, Jr.
*Attorney, Agent, or Firm*—Robert M. Didrick; Samuel Kurlandsky; Robert H. Robinson

[57] ABSTRACT

A first wallboard and a second wallboard in edge-to-edge abutment are secured to an underlying stud by a double acting fastener which bends around the stud from a flange to the web where a screw passing through a bight in the fastener holds it in place. Oppositely oriented wire talons 20 and 25 are extensions of a first arm 17 and a second arm 18, respectively. Talon 20 is impaled in the edge of the first wallboard and talon 25 is impaled in the edge of the second wallboard. A loop 23 in the second arm 18 rests behind the first wallboard and both arms rest behind the second wallboard. A force tending to move either wallboard away from the stud is resisted by both arms.

3 Claims, 7 Drawing Figures

CONCEALABLE DOUBLE ACTING FASTENER FOR WALLBOARD

This invention relates to the construction of interior partitions by the attachment of wallboard panels to a supporting framework of studs, runners, and the like. In particular, it relates to the concealed attachment of pre-decorated gypsum panels to metal or wooden studs.

The use of pre-decorated panels is popular because no further finishing of the erected partition is necessary. It is practical, however, only if the means for fastening the panels to the studs is concealed. The application of adhesives and the bracing of the panels while waiting for the adhesive to bond is time consuming and labor intensive.

Weinar, in U.S. Pat. No. 4,117,644, teaches a fastener which is formed from sheet metal and is screw-attached to a flange of a stud. The fastener includes a plate portion which rests between the back of the panel and the flange, a tongue which is a co-planar extension of the plate and through which the screw is passed, a pair of legs perpendicular to the plate and spaced apart by the tongue, and a terminal return tab on each leg parallel to the plate. The return tabs are triangular barbs and, being co-directional, can only be used to fasten one gypsum panel. A second fastener with the tabs having the opposite orientation must be used to attach a second gypsum panel placed in edge-abutting relation to the first panel. Because the tongue of the second fastener must be slipped behind the first panel, this second fastener cannot be secured to the stud. Another disadvantage of such fasteners is the tendency for the flat, triangular barbs to cleave the gypsum core along the edges of the panel and thus weaken the panel at the points of attachment to the stud. Other disadvantages of such a fastener are that it displaces a relatively large portion of the core and it often bends while being driven into the edge of the panel, causing a visible bulge on the panel face. This is commonly known as "pooching".

It is, therefore, an object of this invention to provide an improved wall construction.

It is a related object of this invention to provide a non-pooching fastener which impales the edge of a wallboard panel without splitting the core material thereof.

It is another to provide a paneled wall construction in which the panels are attached to studs by concealed fasteners which are resistant to disengagement by impact and vibration.

These and other objects of this invention which will become apparent from the following description are achieved by the partition and fastener shown in the drawings, in which.

Figure 1:
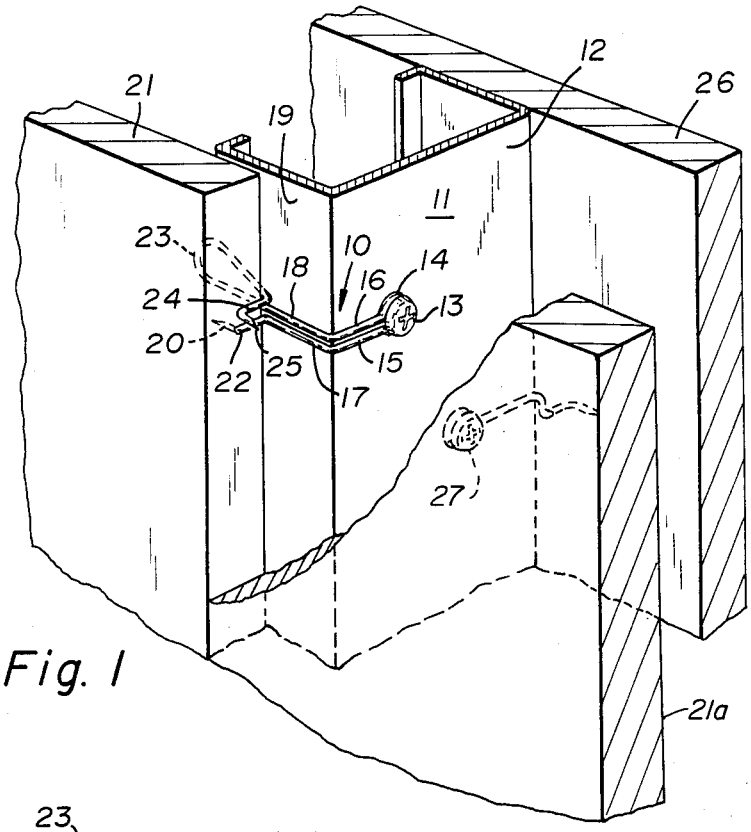
FIG. 1 is a perspective view of a partition of this invention.

In FIG. 1, the impaling pin 10, formed from a single piece of music wire, is secured to the web 11 of the stud 12 by the screw 13 which passes through the bight 14 which connects the first shoulder 15 and the second shoulder 16 of the pin. The first arm 17 and the second arm 18 are at right angles to their respective shoulders 15 and 16 and rest against the flange 19. The first talon 20, impaled in the edge of the vinyl faced panel 21, is parallel to the flange 19 and is connected to the arm 17 by the outwardly projecting finger 22. The loop 23 is a continuation of the second arm 18 and rests between the panel 21 and the flange 19. Jutting out at a right angle from the plane of the loop 23 and arm 18 is the second finger 24 which terminates as the second talon 25. This second talon is parallel to the flange 19 and is adapted to impale the edge of a second panel **21*a* when that panel is shoved ino abutment with the panel 21**.

The partition of FIG. 1 is constructed in such a way that the joints between the gypsum panels on opposite sides of the studs do not fall on the same studs but are staggered so that only one joint falls on each stud. The panel 26 is held against the stud 12 by the hook 27 which is not part of this invention but is described and claimed in my co-pending application Ser. No. 566,912 which was filed on Dec. 30, 1983. The staggered joint partition is preferred because it is easier for one person to erect, it can be constructed one side at a time, and it is the more rigid partition. Other considerations, however, may cause a builder to locate the panel joints on opposite sides of the same studs.

Figure 2:
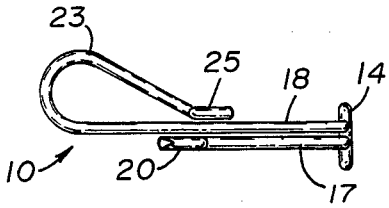
FIG. 2 is a side elevational view of a preferred impaling pin of this invention when oriented as in FIG. 1.
Figure 4:
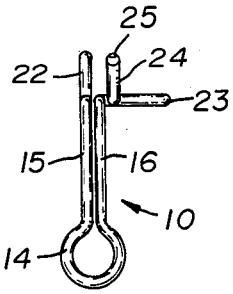
FIG. 4 is an end elevational view of the vertically oriented impaling pin of FIG. 1.
Figure 3:
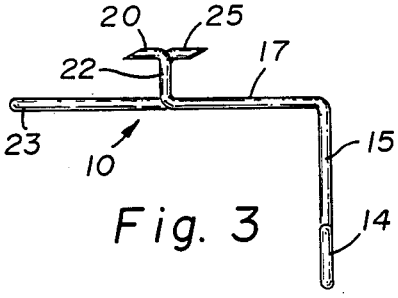
FIG. 3 is a bottom plan view of the impaling pin when oriented as in FIG. 1.

The structure of the impaling pin 10 is shown in more detail in FIGS. 2, 3 and 4 wherein the bight 14 is co-planar with the first shoulder 15 (FIG. 3) and the second shoulder 16 (hidden by shoulder 15) and normal to the plane in which the arms 17 and 18 lie. The finger 22 (FIG. 3) is perpendicular to the arm 17 and the talon 20 is again perpendicular to the finger 22, thereby being parallel to the arm 17. The loop 23 curves in the plane of the arms 17 and 18 and connects the arm 18 with the finger 24 which terminates as the talon 25.

Figure 5:
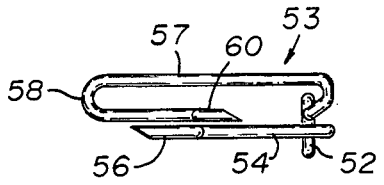
FIG. 5 is a top plan view of a more preferred embodiment of the impaling pin of this invention in which the horizontal plane is parallel to the surface of the drawing.
Figure 7:
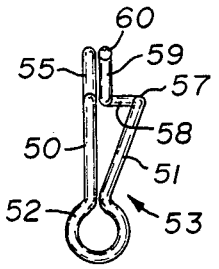
FIG. 7 is an end elevational view of the impaling pin of FIG. 5 in which the vertical planes are parallel to the surface of the drawing.
Figure 6:
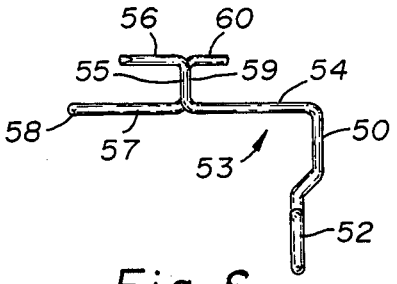
FIG. 6 is a side elevational view of the impaling pin of FIG. 5 in which the horizontal planes are perpendicular to the surface of the drawing.

In FIGS. 5, 6 and 7, the first shoulder 50 and the second shoulder 51 are offset from the bight 52 of the impaling pin 53 to accommodate studs having raised beads along the edges of the web. The first arm 54 is perpendicular to the first shoulder 50 and is bent twice at right angles to form the first finger 55 and the first talon 56. The second shoulder 51 diverges from the first shoulder 50 and is bent at a right angle to form a second arm 57 which extends beyond the first finger 55 and is at first co-directional with the first arm 54 but then is formed into the loop 58 and the second finger 59 and the second talon 60.

A pan head screw or one having a head of similar thickness may be used to hold the preferred impaling pins 10 and 53 to the stud because of the positioning of the bights 14 and 52 against the web of the stud. An impaling pin having its arms connected directly by a co-planar bight so that the bight rests against the flange of the stud must be secured by a special screw having a wafer thin head to avoid an extra large gap between the wallboard and the flange of the stud.

In addition to a plurality of laterally spaced apart studs 11, the partition comprises the common channel shaped floor and ceiling runners to which the studs are attached. The panels are fastened to these runners by common drywall screws which are concealed by trim. When the preferred impaling pins are used, the webs of all of the intermediate studs in the partition face in the same direction so that the impaling pins may be properly oriented at each panel joint. The spacing of the impaling pins along an edge of a panel may be chosen according to particular requirements but 18 or 24 inch intervals are satisfactory for most installations. The talons are from about one-fourth to about three-eighths of an inch long. The centering of the talons in the edge of a panel is determined by the length of the fingers. Precise centering of the talons is not essential, however. The same impaling pin may be used for one-half inch and five-eighths inch thick panels. One of the advantages of this invention is the low cost of the impaling pin; less than 6 inches of 18 gauge wire is required to make each pin.

Erection of a sturdy partition with tight panel joints proceeds quickly and easily with the aid of the impaling pins of this invention. The oppositely oriented talons, being extensions of a first arm and a second arm of the pin, are impaled in the abutting edges of a first wallboard and a second wallboard, respectively. A loop in the second arm, however, rests behind the first wallboard while both arms rest behind the second wallboard. A force tending to move either wallboard away from the stud is resisted by both arms. Thus, the faces of adjacent wallboards remained co-planar even after the partition of this invention had been shaken violently.

While particular embodiments of the invention have been described in detail, it will be understood that the invention may be modified within the spirit and scope of the appended claims.

The subject matter claimed is:

1. A partition comprising a plurality of wallboards in edge-to-edge array; a stud having a web portion and a flange portion; and a concealed impaling pin which secures abutting wallboards to the stud, said impaling pin comprising a continuous piece of wire having, in sequence:

a bight fastened to the web portion of the stud;

a pair of shoulders connected by the bight and parallel to the web portion of the stud;

a pair of arms between the flange portion of the stud and the wallboard;

a pair of fingers between abutting edges of adjacent wallboards; and a pair of oppositely oriented talons;

wherein a first arm of the pair extends only to the juncture of the adjacent wallboards, a second arm extends beyond the juncture and loops back to that juncture, and the talon terminating the first arm is impaled in the edge of the wallboard distal to the web portion of the stud and the talon terminating the second arm is impaled in the edge of the wallboard proximate to the web portion.

2. The partition of claim 1 wherein the bight and the shoulders lie in different but parallel planes.

3. The partition of claim 1 wherein the shoulders are divergent.

* * * * *